US008601998B2

(12) United States Patent
Diggs

(10) Patent No.: US 8,601,998 B2
(45) Date of Patent: Dec. 10, 2013

(54) CYLINDER BLOCK ASSEMBLY FOR X-ENGINES

(76) Inventor: Matthew Byrne Diggs, Farmington, MI (US)

( * ) Notice: Subject to any disclaimer, the term of this patent is extended or adjusted under 35 U.S.C. 154(b) by 10 days.

(21) Appl. No.: 13/517,485

(22) PCT Filed: Sep. 6, 2011

(86) PCT No.: PCT/US2011/050489

§ 371 (c)(1),
(2), (4) Date: Jun. 20, 2012

(87) PCT Pub. No.: WO2012/033727

PCT Pub. Date: Mar. 15, 2012

(65) Prior Publication Data

US 2012/0255516 A1 Oct. 11, 2012

Related U.S. Application Data

(60) Provisional application No. 61/402,912, filed on Sep. 7, 2010.

(51) Int. Cl.
*F02B 77/00* (2006.01)
*F02B 75/22* (2006.01)

(52) U.S. Cl.
USPC ..... 123/195 C; 123/195 R

(58) Field of Classification Search
USPC ..... 123/195 C, 195 R
See application file for complete search history.

(56) References Cited

U.S. PATENT DOCUMENTS

| | | | | |
|---|---|---|---|---|
| 2,625,145 | A | 1/1953 | Brill | |
| 2,698,609 | A | 1/1955 | Brill | |
| 3,000,367 | A * | 9/1961 | Eagleson | 123/51 BB |
| 4,850,313 | A * | 7/1989 | Gibbons | 123/54.2 |
| 5,682,843 | A * | 11/1997 | Clifford | 123/44 C |
| 6,188,558 | B1 * | 2/2001 | Lacerda | 361/115 |
| 6,213,064 | B1 * | 4/2001 | Geung | 123/54.1 |
| 7,121,235 | B2 * | 10/2006 | Schmied | 123/42 |
| 7,150,259 | B2 * | 12/2006 | Schmied | 123/197.5 |
| 7,614,369 | B2 * | 11/2009 | Schmied | 123/55.7 |
| 7,721,684 | B2 * | 5/2010 | Schmied | 123/42 |

FOREIGN PATENT DOCUMENTS

| | | | |
|---|---|---|---|
| CH | 327 076 | A | 1/1958 |
| FR | 512 528 | A | 1/1921 |
| FR | 608 963 | A | 8/1926 |
| GB | 486 210 | A | 6/1938 |

* cited by examiner

*Primary Examiner* — Lindsay Low
*Assistant Examiner* — Charles Brauch
(74) *Attorney, Agent, or Firm* — Peter J. Rashid

(57) ABSTRACT

A cylinder block assembly for an X-engine includes a first block half having two cylinder banks and valley openings between the two cylinder banks; and a second block half fastened to the first block half, the second block half having two cylinder banks and valley openings between the two cylinder banks. The valley openings in the first and second block halves allow an X-engine crank train assembly to be assembled within the cylinder block assembly.

16 Claims, 10 Drawing Sheets

ASSEMBLY PROCESS for DASY X-ENGINE Bottom-End

1) Block half1 & block half2 are placed separated with the crank bore oriented vertical and having access to the crankcase and tops of the cylinder bores.

↓

2) Install a piston assembly (including rings) through the top of each cylinder bore.

↓

3) With (4x)bolts, attach a yoke onto each piston assembly. The end of the yoke that the yoke-bolt head is set onto is oriented towards the valley opening of a block half.

↓

4) Move all of the (piston+yoke) sub-assemblies to the tops of the bores. Rotatably orient the yokes so they are perpendicular to the crankbore.

↓

5) With the crankshaft by itself, install the bearing shells and the bearing block assemblies onto the crankshaft crankpin journals. There are two bearing block assemblies attached to each crankpin.

↓

6) Install bearing shells and thrust bearings into block half1 & block half2.

↓

7) Set the crankshaft and camshafts into block half1 and secure them using temporary means.

↓

8) Move block half2 together with block half1 keeping the dowels aligned with their receiving holes to insure correct engagement. After block halves 1&2 are together, they can be temporarily held using two perimeter bolts attached at low torque. This leaves access through the valley openings for final assembly of the DASY mechanisms.

↓

9) Rotate the bearing block assemblies on the crankpins into position to receive the yokes.

↓

10) Push the pistons down the bores to move each (piston+yoke) sub-assembly into proper engagement with a bearing block. It may be necessary to guide the yokes and bearing blocks together by contacting them through the valley openings.

↓

11) After opposing yokes are fully engaged to each other and to a bearing block, install a yoke-bolt through a valley opening into each yoke to complete the Double-Acting Scotch Yoke (DASY) mechanisms.

↓

12) Remove the temporary fixtures used on the crankshaft and camshafts. Place a valley cover over the valley opening of each block half.

↓

13) Install the cylinder block main bolts using the proper torquing sequence and torque specification to secure the two block halves and two valley covers. Install all block perimeter bolts to complete the DASY X-Engine bottom end assembly.

FIG. 10

CYLINDER BLOCK ASSEMBLY FOR X-ENGINES

CLAIM TO PRIORITY

This application is a National stage application of PCT Application No. PCT/US 11/50489, filed on Sep. 6, 2011, which claims priority to U.S. Application Serial No. 61/402,912, filed Sep. 7, 2010, the entire contents of both are incorporated herein by reference.

BACKGROUND OF THE INVENTION

The invention relates generally to internal combustion piston engines, fluid pumps and similar machines and, more particularly to an X-Engine assembly.

The objective of an engine designer is to provide the best function with regards to performance and efficiency, while also minimizing the amount of noise and vibration that emanate from the engine. It is also desirable to provide an engine that is the smallest, lightest-weight while having a design which can be economically manufactured and serviced.

The most widely used engine configurations in use and today are in-line, "V" and horizontally-opposed or 'flat'. Almost all of these engines use conventional connecting rods ("con rods") in the power conversion system whereby each piston in the engine is coupled to the crankshaft such that there is one con rod per piston in the engine. In a typical "V"-engine, each crankpin on the crankshaft is coupled to two piston-and-con rod assemblies with the two cylinder banks being offset to each other along the axis of the crankshaft to allow the two connecting rods coupled to each crankpin to be side-by-side. In this way, there is an engine main bearing on each side of every crankpin bearing, and each crankpin bearing is sufficiently sized to provide adequate bearing area for two the connecting rod "big-end" bearings so that the resultant bearing pressures encountered as the engine runs are within acceptable range. If an engine is designed having more than two con rods are attached to each crankpin there may be a compromise for either the bearing area of the crankpin or main bearings, or the cylinder bore spacing or the structure of the crankshaft and/or cylinder block that must withstand high cyclic loading. Hence, it has been found that the "V"-engine having two con rods per crankpin allows for an engine design which is satisfactory with regards to having sufficiently strong cylinder block structure, crankshaft structure between the main bearings and crankpin bearings, and acceptable bearing pressures at critical bearing interfaces such as the big-end con rod bearings.

The Scotch yoke is a mechanism for converting the linear motion of a slider into rotational motion of a shaft or vice-versa, and has been demonstrated to be suitable for use in internal combustion piston engines. The piston or other reciprocating part is directly coupled to a sliding yoke with a slot that engages a pin on the rotating crankshaft, with a bearing block is fitted in between the crankshaft and the yoke to provide a cylindrical-cylindrical interface at the crankpin and flat-on-flat interface with the yoke so that the contact pressures at both interfaces are at acceptable levels. The shape of the motion of the piston is a pure sine wave over time given a constant rotational speed of the crankshaft.

The scotch yoke mechanism can be used in a double-ended or "double-acting" fashion such that each reciprocating assembly has a piston at either end, hence a benefit of the double-acting scotch yoke is that it can be used in an X-engine configuration having two reciprocating assemblies for a total of four pistons coupled to each crankpin bearing on the crankshaft in a similar way to the conventional con rod as it is used in "V"-configuration engines which have two con rod and piston assemblies coupled to each crankpin bearing on the crankshaft. By doubling the number of cylinders coupled to each crankpin bearing, the Double-Acting Scotch Yoke used in X-configuration can result in a significantly smaller and lower mass engine for a given bore & stroke and number of cylinders when compared with in-line, "V" and flat engine configurations.

Another advantage of the Double-Acting Scotch Yoke ("DASY") X-Engine over conventional "V"-engines is that the fluid motion inside the crankcase is reduced because opposite pistons simply push air in between them, whereas in "V"-type engines and in-line engines there is a larger mass of fluid in motion inside the crankcase (for a given bore/stroke and number of cylinders) which is pushed out of the cylinders and around the engine's bulkheads in a way that causes larger amounts of fluid friction and necessitates having an empty volume in the engine crankcase between the crankshaft and the oil sump to allow this fluid motion to occur.

Furthermore, the DASY is a mechanism that provides true 'harmonic motion' or pure sinusoidal motion. Thus, DASY engine configurations which have first-order balance have perfect balance, whereas engines which have con rods always have imbalances which are unresolved due to the complex nature of the piston motion using the con rod mechanism which results in multiple orders of vibration of the $1^{st}$, $2^{nd}$ and higher orders.

It should also be noted that a radial engine that employs a master con rod with secondary con rods attached to it is an arrangement which allows more than two cylinders of an engine to be coupled to a single crankpin bearing, but the compromise here is that there are at least two different piston motions (piston displacement versus crankshaft angle) occurring in this type of engine, which greatly complicates any efforts to achieve balance of even the $1^{st}$-order of vibration. Hence, there is no practical method to have $1^{st}$ and $2^{nd}$ order balance for a group of cylinders connected in this way. Furthermore, with the modern fuel injection systems used in engines now, having different piston motions would greatly complicate the calibration and emission-ability of such an engine. Hence, the X-engine configuration using the double-acting scotch yoke has the potential to provide a superior result for many piston engine applications, which today are mostly "V", in-line, and flat engines that employ con rods.

SUMMARY OF THE INVENTION

An object of the invention is to provide a cylinder block assembly for Double-Acting Scotch Yoke (DASY) X-Engine configurations that provides high structural integrity (strength and stiffness), fewer parts, lower mass and smaller size than comparable "V", in-line or flat-engine cylinder blocks (assuming the same number of cylinders and same bore & stroke), and having conventional manufacturing processes for the components, and, lastly, a conventional assembly processes for completing the DASY X-engine bottom end assembly.

In one aspect of the invention, an X-Engine bottom end assembly includes four cylinder banks which are located on two intersecting planes with the crankshaft axis being on the line of intersection of the two planes, and having a Double-Acting Scotch Yoke (DASY) power conversion system which has outward facing coaxial pistons at both ends of reciprocating assemblies which couple the reciprocating motion of the pistons to the rotary motion of the crankshaft, and having each reciprocating DASY assembly offset along the axis of the crankshaft relative to each other such that there are two pairs of opposing cylinder banks and with a bank-offset from one pair of opposing banks to the other, similar to a "V"-engine which has a bank offset from one bank to the other. The axis of each reciprocating DASY assembly, as defined by the common axis of the two pistons is perpendicular to the crankshaft axis.

In a second aspect, the cylinder block assembly for an X-engine primarily consists of four parts—two "block halves" and two "valley covers"—which are connected in series and secured by a group of main bolts which are through-bolts with the clamp force from the fasteners utilized to secure the four parts together at three interfaces. The two block halves are largely or entirely similar, with one block half containing a pair of adjacent cylinder banks, and the other block half contains another pair of adjacent cylinder banks The valley covers, which are the outer parts in the series, cover up openings between the adjacent banks of cylinders and of each block half. Thus, with all four primary components fastened together, the resulting structure resembles two conventional "V"-engine blocks bolted together bottom face-to-bottom face. The plane of the interface between the block halves intersects the central axis and is angularly offset from the two planes which contain the four cylinder banks Each block half has bulkheads that are substantially perpendicular to the central axis, and have semicircular features along the central axis which are for supporting an engine main bearing shell. It is also possible to have similar sets of bearing support features at the interface between block halves for supporting camshafts, balance shaft, or other rotating parts. The other remaining structures in the block—including the cylinder support structure that connects the bulkheads and provides support for the cylinders including the water jackets around the cylinders (not shown in drawings), and the deck surfaces which are flat surfaces at the outermost extensions of each cylinder bank, and the side walls which extend from the plane of interface between block halves and join the structure around the cylinder banks, and the planes of the bulkheads being perpendicular to the central axis—are substantially the same as for a "V"-engine block. Manufacturing processes for making each block half—such as casting, machining and bore honing—may also be expected to be practically the same, or very similar to, established processes used for manufacturing "V"-engine cylinder blocks.

A third aspect of this invention is a method for assembling the X-Engine bottom end assembly including the crankshaft, DASY reciprocating assemblies and the cylinder block assembly. The desired result of assembling such an engine is to have all of the parts go together using conventional assembly processes without having any compromises to the end result in the way of function, reliability, package size, weight or cost. For assembling a conventional "V"-engine bottom end assembly, the first step is to install the main bearings, then the crankshaft, and then the main bearing caps are attached to the cylinder block to secure the crankshaft. Then the "piston-and-rod" assemblies can be installed through the tops of the cylinder bores and brought into contact with the crankpins on the crankshaft, and then last is to install the con rod caps to complete the bottom end assembly. Since the bottom of the cylinder block always remains open, there is no issue for accessing the con rods and con rod caps to bolt them together. For the DASY X-engine, however, the problem is that having a two-piece block assembly that consists of only two pieces which are like "V"-engine blocks would "trap" the crankshaft inside after the two block pieces are bolted together which prevents being able to bolt the DASY assemblies together around the crankshaft which is the essential final step. Note that it is impossible to bring two block halves together around a completed X-Engine crank train assembly, hence it is necessary to make allowances for being able to access the scotch yokes and connect them around the crankshaft for the final step of the bottom end assembly. The solution here is to have access openings in the "valley" between the two adjacent cylinder banks and of each block half which results in having openings in two opposing valleys (of the four-valley X-engine) into the spaces inside the crankcase between the bulkheads, whereby each space houses an X-4 group with two DASY reciprocating assemblies for a total of four pistons. These valley openings work in conjunction with a unique X-engine scotch yoke array which places all four of the yoke bolt paths for each X-4 group through the a valley opening. Having access to the scotch yokes after the two block halves are joined together allows them to be joined together with the bearing blocks and crankshaft and all of the yoke bolts can be installed directly through the a valley opening to complete the DASY X-engine bottom end assembly.

In view of the foregoing, the invention is directed to a cylinder block assembly for an X-engine that includes a first block half having two cylinder banks and an opening between the two cylinder banks; and a second block half fastened to the first block half, the second block half having two cylinder banks and an opening between the two cylinder banks The openings in the first and second block halves allow an X-engine crank train assembly to be assembled within the cylinder block assembly.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

FIG. 2(*b*) is an isometric view of the DASY X-8 engine bottom end assembly;

FIG. 2(*c*) is a top view of the DASY X-8 engine crank train assembly;

FIG. 2(*d*) is a top view-hidden-line view of the DASY X-8 engine bottom end assembly;

FIG. 3(*b*) is a side view showing the crankcase side of a block half of the X-8 engine cylinder block assembly;

FIG. 3(*c*) is a top view-hidden-line view of the X-8 engine cylinder block assembly;

FIG. 7(*b*) is a top view-hidden-line view of the DASY X-4 engine crank train of FIG. 5 showing the installation paths of the yoke bolts being in opposite corners of the X-4 array;

FIG. 8(*b*) is a top view-section view of the DASY X-8 engine bottom end assembly of FIG. 8(*a*) with four of the yoke bolts shown extended outwards along their centerlines to reveal the installation path of the yoke bolts through the valley openings during the DASY X-engine bottom end assembly process;

FIG. 9(*b*) is an isometric view of the DASY X-8 engine crank train assembly showing the orientation of the yoke bolts;

FIG. 9(*c*) is an isometric view of the DASY X-12 engine crank train assembly showing the orientation of the yoke bolts; and FIG. 10 is a flow chart of a method for assembling a DASY X-engine bottom end assembly.

DETAILED DESCRIPTION OF THE INVENTION

Figure 1:
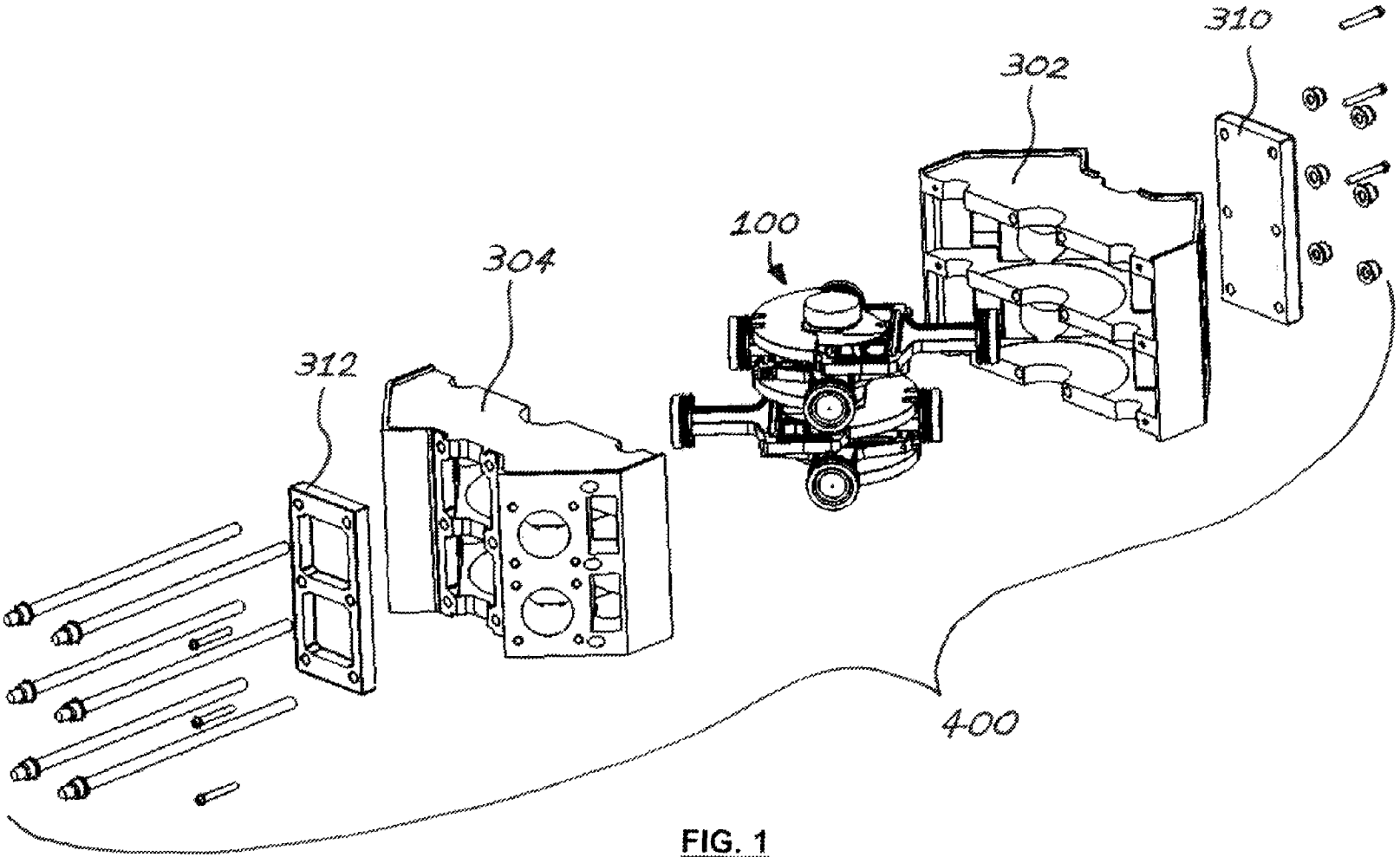
FIG. 1 is an exploded view of the DASY X-8 engine bottom end assembly.
Figure 2A:
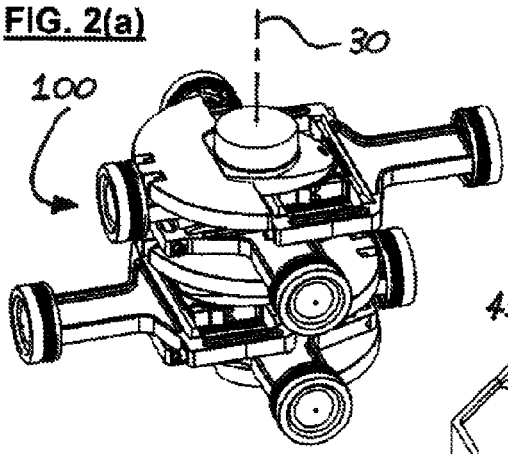
FIG. 2(*a*) is an isometric view of the DASY X-8 engine crank train assembly.
Figure 2B:
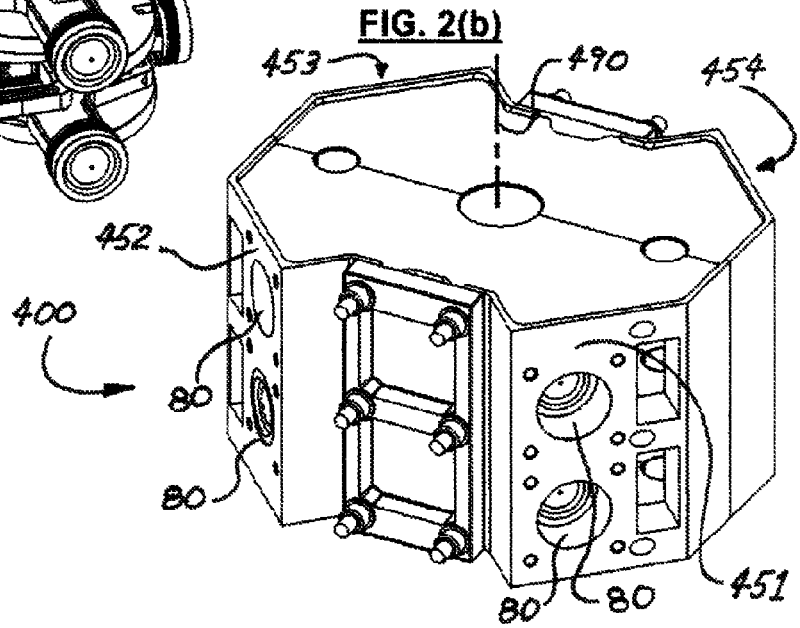
Figure 2C:
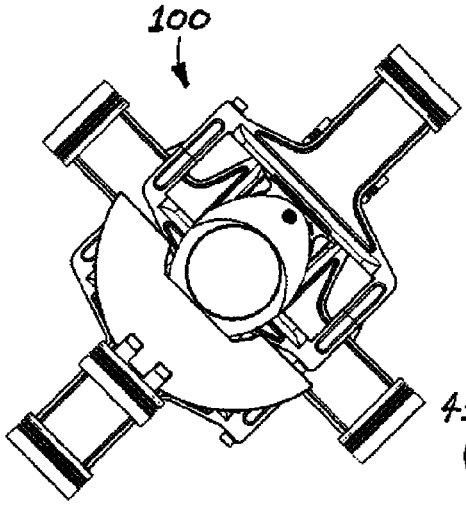
Figure 2D:
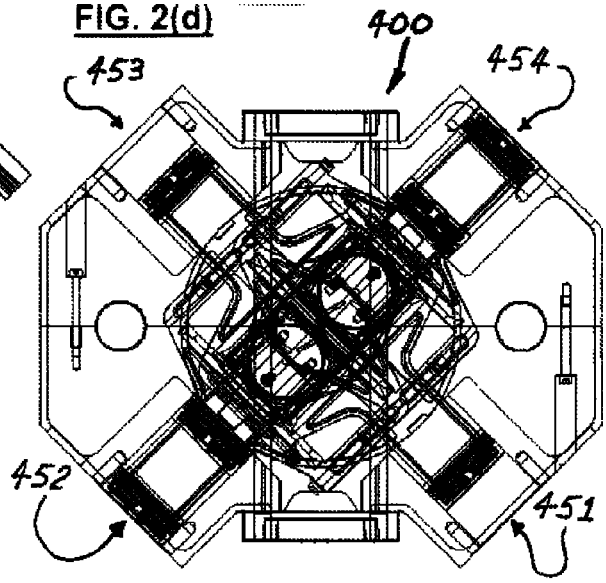

Referring now to FIG. 1, a DASY X-8 engine bottom end assembly 400 is shown in exploded view to reveal all of the primary components and assemblies. As used herein, an X-engine bottom end assembly is defined as the X-engine cylinder block assembly and the moving parts contained within which convert the reciprocating motion of the pistons in the X-engine to rotary motion at the crankshaft. In the center of the bottom end assembly 400 is a DASY X-8 engine crank train assembly 100, which are the moving parts of the bottom end assembly 400 and are packaged inside of the X-8 engine cylinder block assembly 300 (shown in exploded view in FIG. 4), which is a series of parts held together by threaded fasteners 421-426, such as bolts, and the like. As shown in FIG. 1, the main parts of the X-8 engine cylinder block assembly 300 of the invention are from right-to-left: a valley cover 310, a block half 302, a block half 304 and a valley cover 312.

Referring now to FIGS. 2(*a, b*), the DASY X-8 engine crank train assembly 100 and the DASY X-8 engine bottom end assembly 400, respectively, are shown in isometric view. In FIG. 2(*b*),the four cylinder banks 451-454, which each consist of a coplanar group of cylinders 80 and a central axis 490 that is collinear with the crankshaft axis 30 (as shown in FIG. 2(*a*)) of the DASY X-8 engine crank train assembly 100 is shown. In FIG. 2(*c*), a top view of the DASY X-8 crank train assembly 100 is shown, and FIG. 2(*d*) shows a top view-hidden-line view of the DASY X-8 engine bottom end assembly 400 with four cylinder banks 451-454 .

Figure 3A:
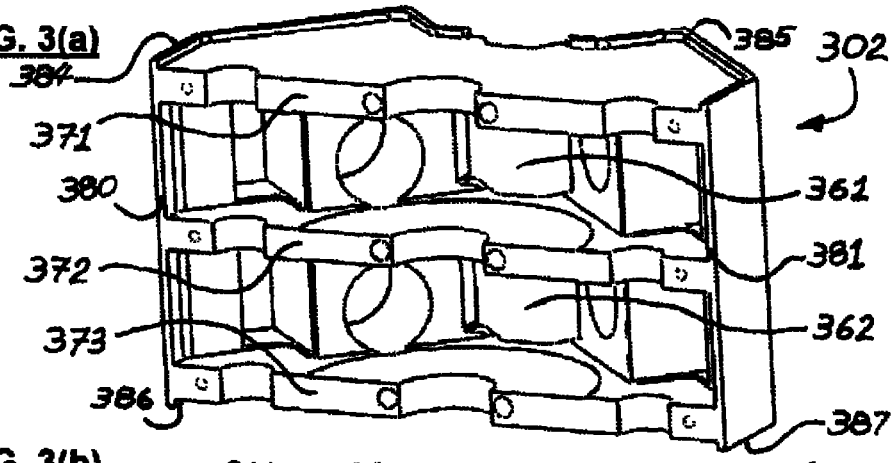
FIG. 3(*a*) is an isometric view of a block half of the X-8 engine cylinder block assembly.
Figure 3B:
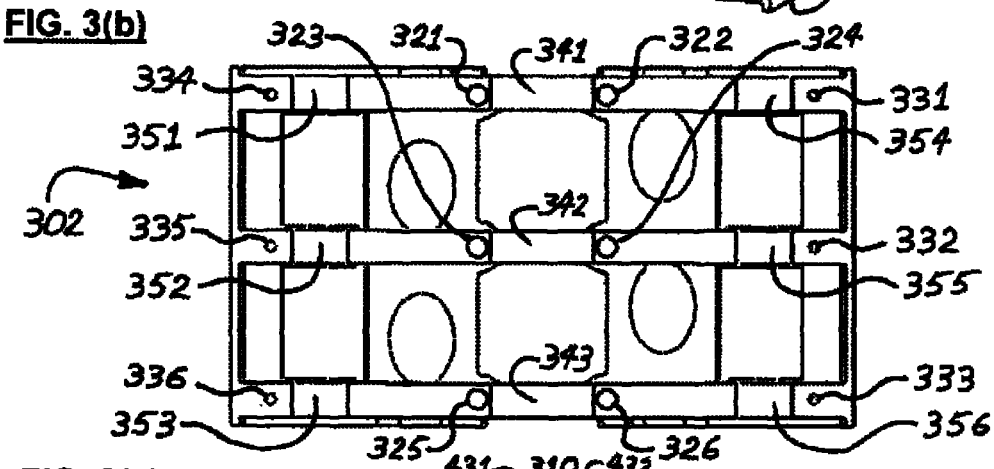
Figure 3C:
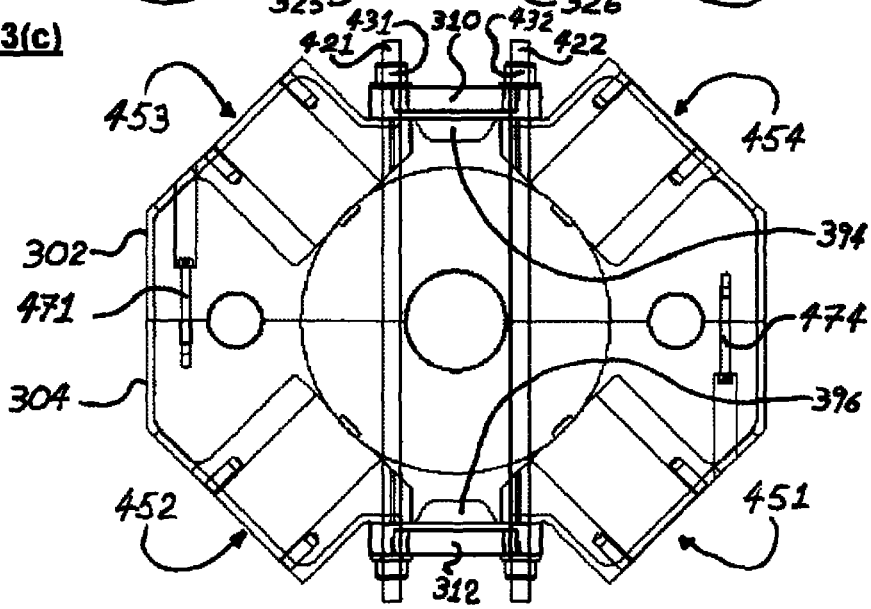

FIG. 3(*a*) is an isometric view of block half 302, and FIG. 3(*b*) is a side view of the block half 302 revealing the crankcase side. FIG. 3(*c*) is a top view-hidden-line view of the X-8 engine cylinder block assembly 300. As discussed herein, block half 302 and block half 304 are identical. However, it is to be understood that in practical applications, there may be differences between the two block halves for reasons, such as, attachment features for parts that attach to the periphery of the cylinder block assembly 300, or other unique features, such as, coolant passages and oil passages that do not relate to this invention. Furthermore, a typical production cylinder block assembly is a much more complex part than what is shown herein and contain detail features in the castings, such as, fillets and draft angles and other design details that provide better structural efficiency and ease of manufacturing, etc., and other features, such as, coolant jackets, oil passages and mounting features, and the like—all of which are not shown herein for clarity. However, it should be understood that only the key cylinder block features that relate to this invention are shown and discussed herein.

Figure 4:
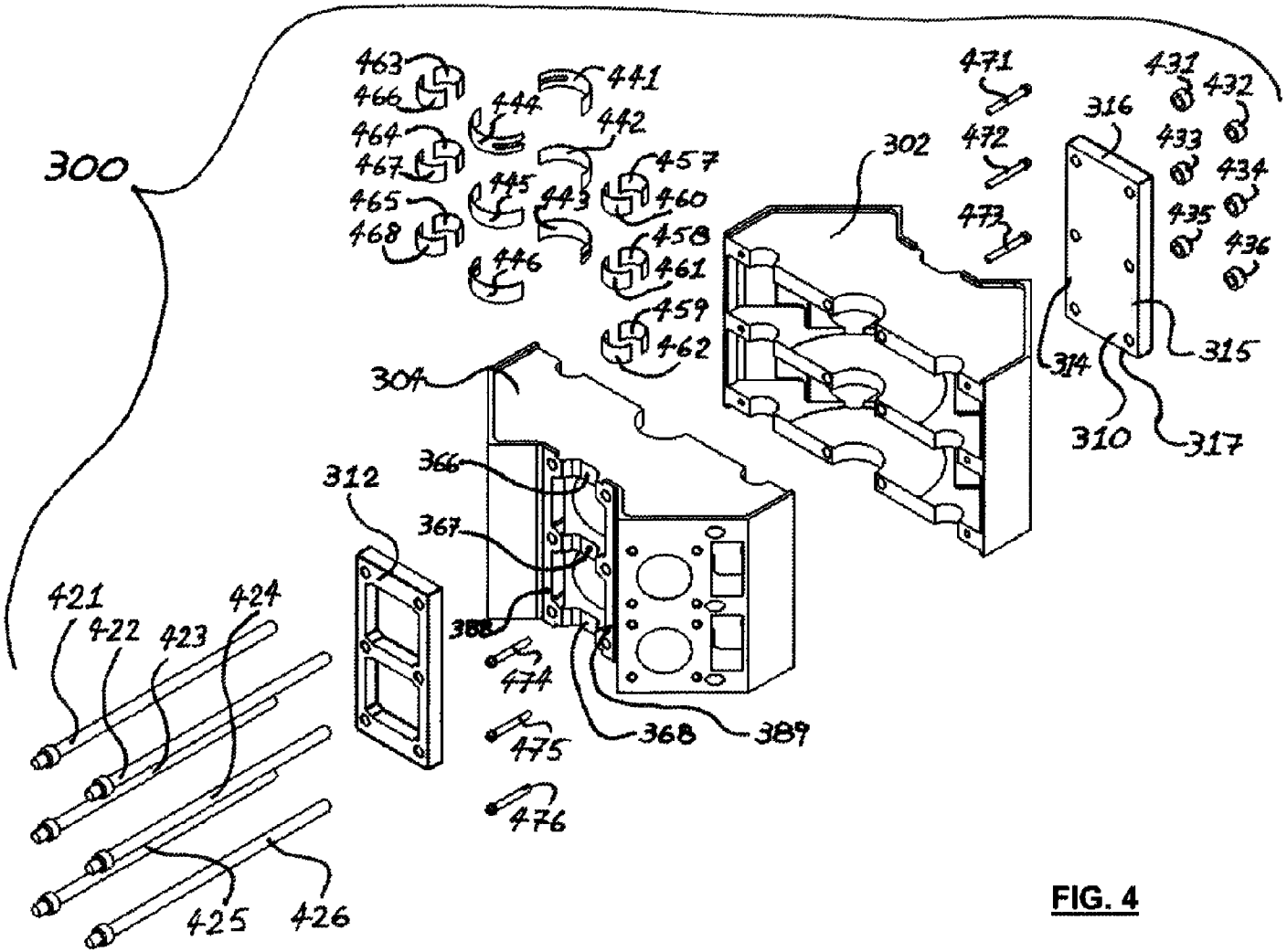
FIG. 4 is an exploded view of the X-8 engine cylinder block assembly.

Shown in FIGS. 3(*a, b*) and FIG. 4 are several features: bulkheads 371-373, which are the primary beam structures that are perpendicular to the central axis 490 (FIG. 2(*b*)); semicircular main bearing mount surfaces 341-343 with one on each bulkhead 371-373 and which are concentric with the central axis 490; semicircular bearing mount surfaces 351-356, which are shown in two coaxial arrays with one on each bulkhead for each array, and which are suitable for other shafts, such as camshafts, balance shafts, and the like; through-bolt-holes 321-326 for the installation of the main bolts 421-426, which are configured here with two holes through each bulkhead 371-373 and having one through-bolt-hole 321-326 substantially next to both ends of each main bearing mount surface 341-343; three through holes with counter-bores 334-336 located at one end of the bulkheads 371-373 for accepting the large end of bolts and three threaded holes 331-333 located at the other end of the bulkheads 371-373; valley openings 361, 362, are located between adjacent bulkheads 371, 372 and 372, 373 respectively, and between the two cylinder banks 453, 454, for which their purpose is to allow for completion of the DASY X-engine bottom end assembly process. All of these features are aligned in a mirror-image fashion from block half 302 to block half 304 when the two block halves are mated in the cylinder block assembly 300 to allow the fastener through holes 321-326 to align for main bolts 421-426 and to align the counter-bored through-holes 334-336 with the threaded holes 331-333 for perimeter bolts 471-476. Also, the main bearing mount surfaces 341-343 align from block half 302 to block half 304, as do the shaft bearing mount surfaces 351-353 of block half 302 align with surfaces 354-356 of block half 304, and likewise for surfaces 354-356 of block half 302 align with surfaces 351-353 of block half 304.

The two block halves 302, 304 each have a coplanar surface machined into the part with precision such that both halves go together to mate all of the necessary walls together to seal the crankcase from the outside. With regards to clamping and sealing of this block half-to-block half interface, this assembly is similar to "V"-engine cylinder blocks which are designed with a "girdle" structure that bolts on to a flat surface at the bottom of the cylinder block with a metal on metal interface and uses conventional sealing methods to achieve a reliable seal around the engine crankcase. The block half-to-block half interface and the two valley cover-to-block half interfaces of the DASY X-engine cylinder block assembly 300 can also be sealed using the same reliable methods. Regarding the perimeter bolts 471-476, these fasteners provide additional clamp force between the two block halves 302, 304 to insure adequate sealing of the crankcase and to further strengthen the cylinder block assembly 300 and provide necessary support for any shaft bearings 457-468, and therefore may also be located at any position where the two block halves 302, 304 contact each other besides those described in the figures, and may be of any suitable fastener configuration.

It is typical for multi-cylinder engines to have a thrust bearing to prevent axial movement of the crankshaft. There is no thrust bearing shown herein, but one skilled in the engine engineering art can understand that a thrust bearing can be included at any of the cylinder block bulkheads 371-373 with an appropriate interfacing bearing surface on the crankshaft 116.

In FIG. 3(*c*) and FIG. 4, the main bolts 421, 422 and the nuts 431, 432 (the other bolts 423-426 and nuts 433-436 are not visible in FIG. 3(*c*)) are shown that fasten together the series of four main parts: the valley cover 310, the block half 302, the block half 304, and the valley cover 312. The main bolts 421-426 are secured at each end and are loaded in tension to impart a compressive force on the block halves 302, 304 and the valley covers 310, 312. There are several types of threaded fasteners that can render the same result for clamping together the primary parts of the cylinder block assembly 300, including, but not limited to, threaded shafts with nuts at either end or a bolt with a nut at one end, or having a threaded hole in one of the two valley covers 310, 312 and having a bolt-head or threaded fastener with a nut anchored at the other valley cover 310, 312.

Also shown in FIG. 3(*c*) and FIG. 4 are perimeter bolts 471, 474 (the other bolts 473-476 are not visible in this view) that add an additional clamping force to the extreme outer ends of the two block halves 302, 304 to insure sealing of the outer rails and to help secure the bearings 457-468.

As is typical for cylinder block assemblies, the X-engine cylinder block assembly 300 uses an alignment means, such as dowel pins (not shown) at the valley cover 310, 312-to-block half 302, 304 interfaces and the block half 302-to-block half 304 interface.

Referring to FIG. 4, each valley cover 310, 312 has flat surfaces 314, 315 that interface with flat surfaces 389, 388 on each block half 302, 304 to provide a sufficiently large surface for transmitting the forces from the main bolts 421-426 and to facilitate sealing of this interface. Also, on the top end of each block half 302, 304 are sealing rails 384, 385 (shown in FIG. 3(*a*)) that are coplanar with sealing surface 316 of each valley cover 310, 312 to facilitate sealing with an engine end cover (not shown), or other part or assembly, On the bottom end of each block half 302, 304 are sealing rails 386, 387 (shown in FIG. 3(*a*)) that are made coplanar with sealing surface 317 of each valley cover 310, 312 to facilitate sealing with an engine end cover (not shown), or other part or assembly.

By using the main bolts 421-426 to clamp the block halves 302, 304 with the valley covers 310, 312, a very high amount of clamp force—which is needed to support the high loads typically experienced by the main bearings 441-446—statically secures the valley covers 310, 312 to the block halves 302, 304 to essentially make the four parts behave as a single monolithic structure, which results in a high level of structural integrity for the cylinder block assembly 300.

Another intended feature of the X-engine cylinder block assembly 300 is to provide a series of orifices 394, 396 in two locations (shown in FIG. 3(*c*)) in the space between the valley cover 310, 312 and the block half 302, 304, respectively. This is achieved by recesses 366-368 (shown in FIG. 4) formed in the outermost part of each bulkhead 371-373 of each block half 302, 304 such that each valley cover 310, 312 achieves a line of sealing along each side 314, 315 (shown in FIG. 4) corresponding to surfaces 389, 388 (shown in FIG. 4) of each block half 302, 304, but allows a gap between the valley cover and the bulkheads 371-373 to form these two series of orifices 394, 396 (shown in FIG. 3(*c*)). When used in an X-engine in which the central axis 490 has a substantial vertical orientation, these series of orifices 394, 396, which run substantially parallel to the central axis 490, allow oil to fall due to gravity from the upper parts to the lower parts of the X-engine and flow back to an oil sump (not shown), which would logically be located lower in elevation than the bottom-most bulkhead 373. It should be understood that the recesses 366-369 could be formed in the valley covers 310, 312, rather than the bulkheads 371-373, and still achieve the same oil-draining effect.

As described above, a new cylinder block assembly 300 for X-engines consists primarily of two parts called "block halves" 302, 304, each resembling "V"-engine cylinder blocks that attach to each other in a "bottom face-to-bottom face" relationship to achieve a simple, strong, very rigid X-engine cylinder block structure that can be easily manufactured using conventional methods. There are also openings in the valleys between the two cylinder banks of each block half 302, 304 that provide a capability to access X-engine components inside the engine crankcase after the two block halves 302, 304 are put together.

As described below, the Double-Acting Scotch Yoke (DASY) X-engine crank train assembly 100 is specifically well-suited to utilize this unique new X-engine cylinder block assembly 300 that allows for the final assembly of the DASY reciprocating assemblies 12 to occur after the two block halves 302, 304 are put together around the centrally located crankshaft 116. From looking at FIG. 1, one should realize the apparent challenge for completing the two-piece X-engine cylinder block assembly 300 around the unique DASY X-engine crank train assembly 100. The key is that the scotch yoke reciprocating assemblies 12 must be completed after the two block halves 302, 304 have been assembled around the crankshaft 116.

Figure 5:
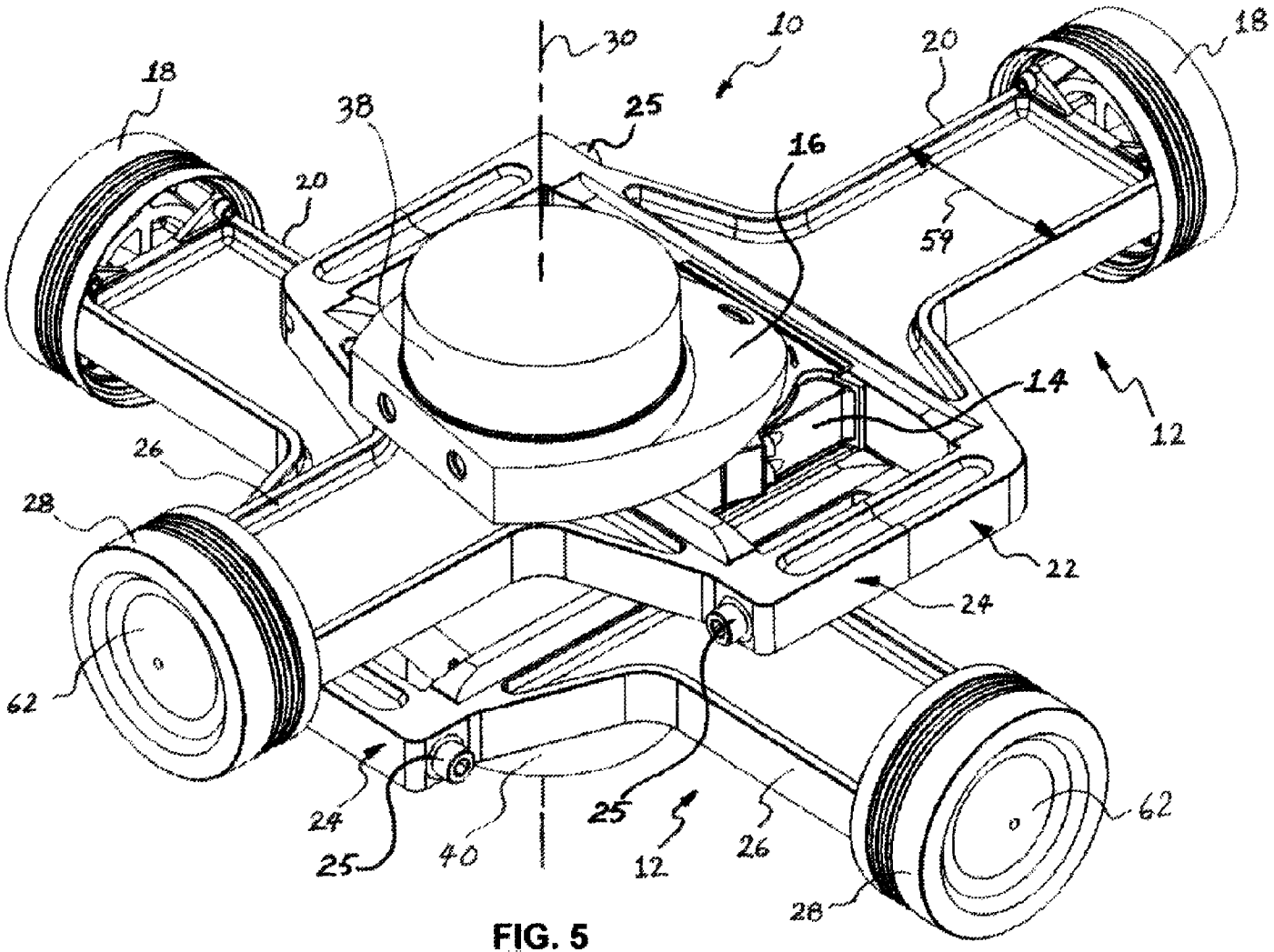
FIG. 5 is an isometric view of the DASY X-4 engine crank train which includes one crankshaft and two DASY reciprocating assemblies with a total of four pistons (for FIGS. 5, 6, 7(*a*)-(*b*), the crankshaft does not include counterweights to allow viewing of the parts)

Referring now to FIG. 5, the Double-Acting Scotch Yoke (DASY) X-engine crank train assembly 10 is shown. The DASY X-engine crank train assembly 10 is also referred herein as an "X-4 engine group." It will be appreciated that the cylinder block assembly 300 of the invention is not limited to housing a single "X-4 engine group" shown in FIG. 5, and that multiples of the "X-4 engine group" that are coupled to a multi-crankpin crankshaft can be housed within the cylinder block assembly 300 of the invention. For example, the X-8 engine crank train 100 (FIG. 9(*b*)) can be formed using two "X-4 engine groups" on the same crankshaft 116 (shown in FIG. 9(*a*)), an X-12 crank train 200 (FIG. 9(*c*)) has three X-4 groups 10, and so on. DASY X-engine configurations which are perfectly balanced and even-firing for 2-stroke, 4-stroke and other engine cycles have potential to satisfy the needs for practical engine applications.

Figure 6:
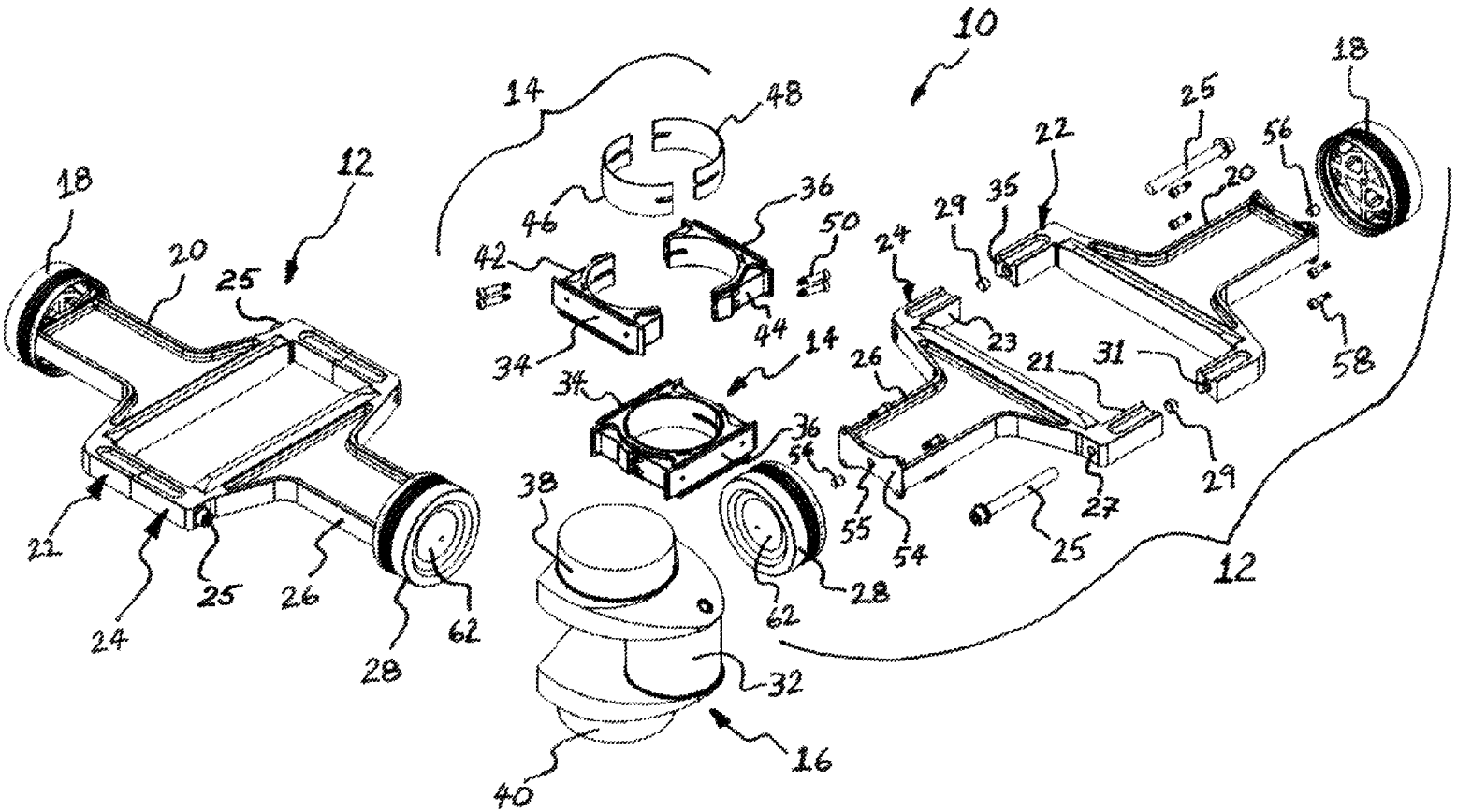
FIG. 6 is an exploded view of the DASY X-4 engine crank train of FIG. 5 including two DASY reciprocating assemblies (one in exploded view) with a total of four pistons, two bearing block assemblies (one in exploded view) and a crankshaft according to an embodiment of the invention.

Referring now to FIGS. 5 and 6, the Double-Acting Scotch Yoke (DASY) X-Engine crank train 10 is shown. In general, the engine crank train 10 includes two DASY reciprocating assemblies 12, two bearing block assemblies 14 and a crankshaft 16. In the illustrated embodiment, the X-engine crank train 10 is configured as a DASY X-4 crank train. The double-acting scotch yoke "DASY" assembly 12 forms a basic building block of the DASY X-engine crank train 10 and comprises four components joined together in series:

1) a first piston 18;

2) a first yoke 22 rigidly attached to the first piston 18;

3) a second yoke 24 rigidly attached to the first yoke 22; and 4) a second piston 28 rigidly attached to the second yoke 24. It should be noted that the first piston 18 is identical to the second piston 28, and the first yoke 22 is identical to the second yoke 24.

The yokes 22, 24 are rigidly connected to each other by using a pair of threaded fasteners 25, such as bolts, and the like, that are passed through a non-threaded hole 27 in one leg 21 of the yoke 22, 24 and received in a threaded hole 31 in the leg 23 of the other yoke 22, 24, as shown in FIG. 6. A dowel 29 is positioned within a separate countersunk bore (not shown) that can be on-axis with holes 27, 31 or can be offset from the axis of the holes 27, 31. Each leg 21, 23 of each yoke 22, 24 has a planar end surface 35 that forms a flat-to-flat interface between the two yokes 22, 24 when assembled. That is, each yoke 22, 24 has two planar end surfaces 35 that form a flat-to-flat interface between the two yokes 22, 24.

It is also noted that the yokes 22, 24 are identical to each other so that the same part can be used on both sides of the bearing block assembly 14 by rotating one of the yokes 180° with respect to the other yoke, which results in a reduction of different parts necessary in the assembly 12, and places the heads of the two yoke bolts 25 in a diagonal relationship with respect to the piston axes 33 and the plane where the two yokes 22, 24 contact each other.

One aspect of the invention is that the yokes 22, 24, the dowels 29, the threaded fasteners 25 and the pistons 18, 28 of the DASY assembly 12 in a purely symmetrical relation to a common, center axis 33 of the two opposing pistons 18, 28, and the common, center axis 33 of the two opposing pistons 18, 28 is perpendicular to a center axis 30 of the crankshaft 16 in the assembled X-engine configuration, as shown in FIG. 5. This feature enables the center-of-mass of the DASY assembly 12 to be located on the common, center axis 33 of the two opposing pistons 18, 28, which is desirable in order to achieve balance of reciprocating and rotating masses during operation of the X-engine.

The piston rings function in the same way as rings for conventional con rod piston-engines. Each piston 18, 28 includes a combustion face 62 on its end, which is formed to suit the requirements of the combustion process being used.

Each bearing block assembly 14 includes two identical bearing block halves 42, 44 and capture a pair of 180° bearing shells 46, 48 that surround the crankpin 32 in a slidable, rotatable manner. A plurality of threaded fasteners 50, such as bolts, and the like, hold the bearing block assembly 14 together. The two bearing block assemblies 14 are assembled around the crankpin 32 of the crankshaft 16. Each bearing block assembly 14 is coupled to its respective DASY assembly 12 by two linear bearing surfaces 34, 36 located at opposing ends of the bearing block assembly 14.

Figure 7A:
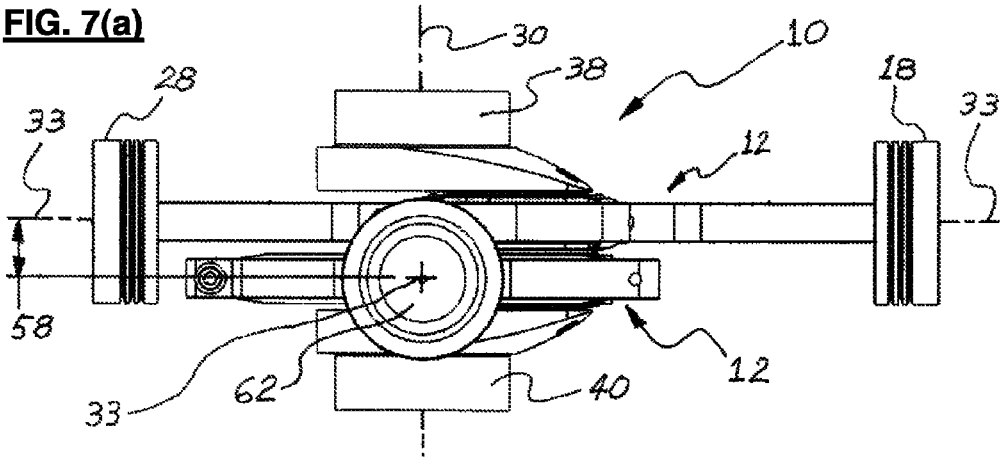
FIG. 7(*a*) is a side view of the DASY X-4 engine crank train of FIG. 5 showing the two DASY reciprocating assemblies being offset along the axis of the crankshaft.
Figure 7B:
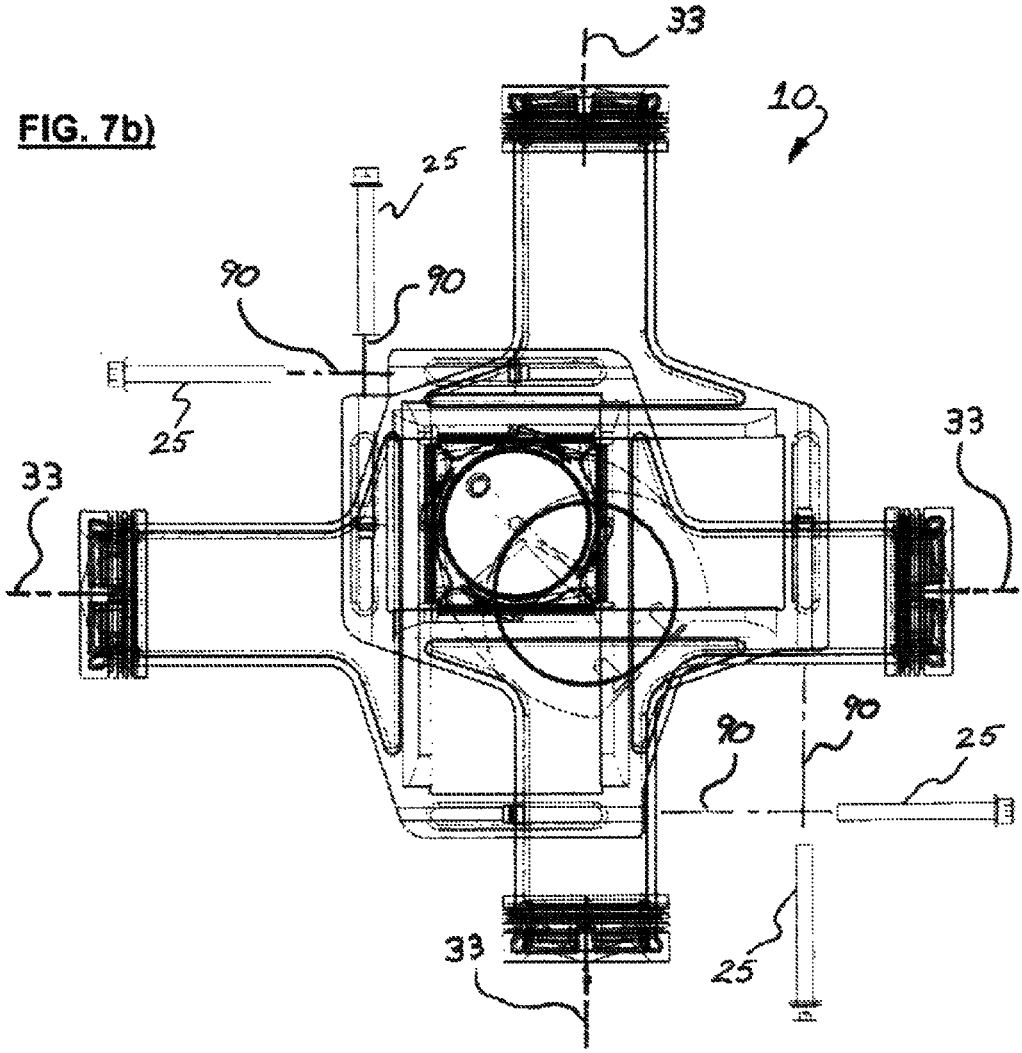

As shown in FIGS. 5, 6 and 7(*a, b*), the crankshaft 16 has its main bearings 38, 40 positioned on the center axis 30 of the crankshaft 16 so that as the crankshaft 16 rotates, the crankpin 32 is rotating around the center axis 30 of the crankshaft 16 in an eccentric fashion.

In the illustrated example of the DASY X-4 engine crank train 10 shown in FIGS. 5, 6 and 7(*a, b*), there are two bearing block assemblies 14 disposed about the crankpin 32 of the crankshaft 16 with each bearing block assembly 14 axially separated from one another and occupying a space along the outer surface of the crankpin 32 and each facing in a different orientation. Specifically, the two bearing block assemblies 14 are oriented 90° with respect to each other. Referring now to FIG. 7(*a*), is shown a side-view of the DASY X-4 crank train 10 with the axis 33 of one DASY assembly 12 shown with an offset 58 relative to the axis 33 of the other DASY assembly. This offset 58 is along the axis 30 of the crankshaft 16. In FIG. 7(*b*) the X-4 crank train 10 is shown in top view to reveal a right-angle relation of the two DASY center axes 33 which both intersect the axis of the crankshaft 30.

It is noted that the interface between the DASY reciprocating assembly 12 and the bearing block assembly 14 are two flat-to-flat sliding interfaces (i.e., linear bearing surface 34 contacts yoke 24, and linear bearing surface 36 contacts yoke 22) that are perpendicular to the common, center axis 33 of the two opposing pistons 18, 28. The two bearing block assemblies 14 surround and engage the crankpin 32 of the crankshaft 16 and revolve, but do not rotate, around the center axis 30 of the crankshaft 16 as the crankshaft 16 rotates. Each DASY reciprocating assembly 12 is coupled to the bearing block assembly 14 in such a way that rotating motion of the crankshaft 16 is translated to a reciprocating (pure sinusoidal) motion of the DASY reciprocating assemblies 12.

For the X-4 engine crank train 10, the two DASY reciprocating assemblies 12 are mounted transversely with respect to the crankshaft axis 30, which results in having the motion of the two DASY assemblies 12 being 90° out of phase with respect to each other, so for the X-4 crank train 10 one piston crosses through top-center position for every 90° of crankshaft 16 rotation.

Also shown in FIG. 7(*b*) are the yoke bolts 25 that are separated from the two yokes 22, 24 and revealing the axes 90, which are the lines that the yoke bolts 25 move along during the assembly process to fasten the two yokes 22, 24 together. It is notable that the four axes 90 of the yoke bolts 25 lie in two opposite corners of the X-4 engine crank train 10. It should also be noted that the yoke bolt 25 as shown is one embodiment for fastening the yokes 22, 24 together, however there are several other fastening configurations which can be used at this interface such as a stud-and-nut, or other fastener arrangements.

Figure 8A:
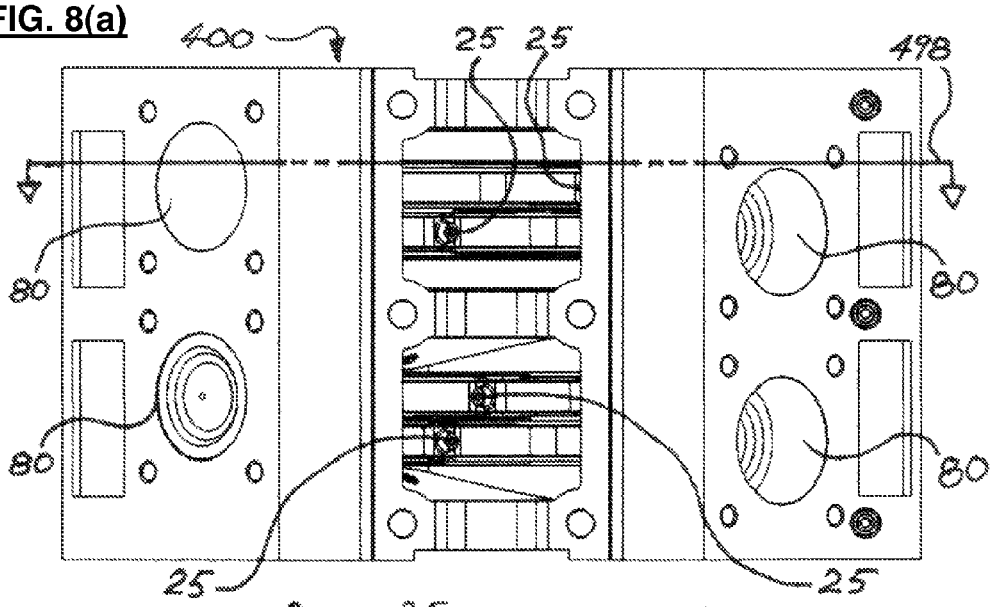
FIG. 8(*a*) is a side view of the DASY X-8 engine bottom end assembly with the main bolts and valley covers removed, and has a section line to define the view for FIG. 8(*b*)
Figure 8B:
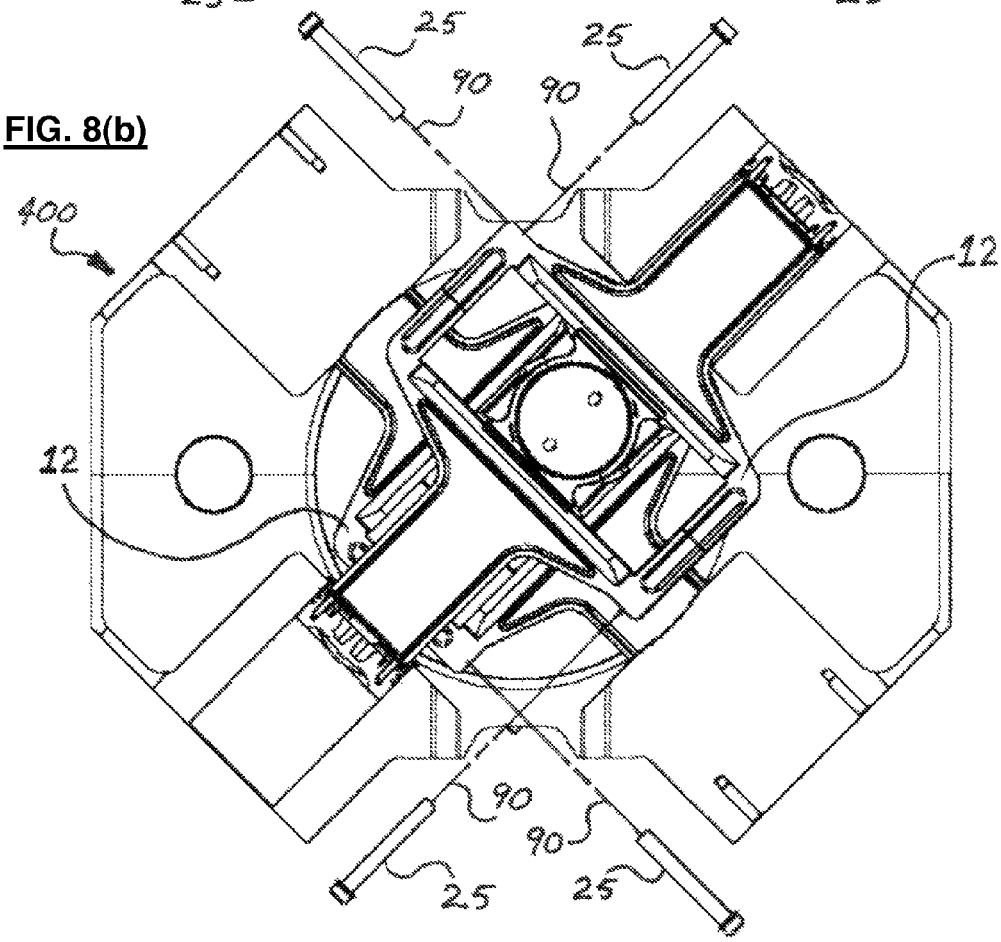

In FIG. 8(*a*), the DASY X-8 engine bottom end assembly 400 with the valley covers 310, 312 and main bolts 421-426 removed to reveal the view through the valley openings 361, 362 showing the sides of the four DASY reciprocating assemblies 12 is shown. Also visible are the heads of four of the yoke bolts 25.

A section line 498 in FIG. 8(*a*) defines the section view shown in FIG. 8(*b*), which is a top view-section view of the DASY X-8 engine bottom end assembly 400. Here the four yoke bolts 25 of the top two DASY reciprocating assemblies 12 are shown extended away from the yokes 22, 24 along the axes 90, which are the lines that the yoke bolts 25 move along during the bolt-installation process to fasten the two yokes 22, 24 together. It is noted that the axes 90 are collinear with the threaded hole 31 in the yokes 22, 24 (as shown in FIG. 6). It can be seen that the yoke bolts 25 can pass through the valley openings 361, 362 in the cylinder block assembly 300. This feature enables the X-engine cylinder block assembly 300 to be a simple, rigid and strong structure with only two primary parts that can be easily manufactured for a series of DASY "X-4 engine groups" from four cylinders for the DASY X-4 engine crank train 10, and in increments of four cylinders, for example, X-8, X-12, X-16, and the like. It will be appreciated that the valley openings 361, 362 may exist in only one cylinder block half 302, 304, rather than in both cylinder block halves 302, 304 in this illustrated embodiment, and still enable assembly of the X-engine crank train 10, 100 within the cylinder block assembly 300.

In another example, the X-8 engine crank train assembly 100 shown in FIGS. 1, 2(*a*), 2(*c*) and 9(*b*) is housed within the X-8 engine bottom end assembly 400, as shown in FIGS. 1 (exploded view), 2(*b*), 2(*d*), 8(*a*) and 8(*b*). The X-8 engine crank train assembly 100 consists of four DASY reciprocating assemblies 12 that are coupled to a single crankshaft 116 that has two crankpins 192, 194 (see FIGS. 9(*a, b*)). Each crankpin 192, 194 is coupled to the two DASY assemblies 12 to form a Double-Acting Scotch Yoke (DASY) X-Engine crank train 10, as shown in FIGS. 5, 6, 7(*a*) and 7(*b*).

Figure 9A:
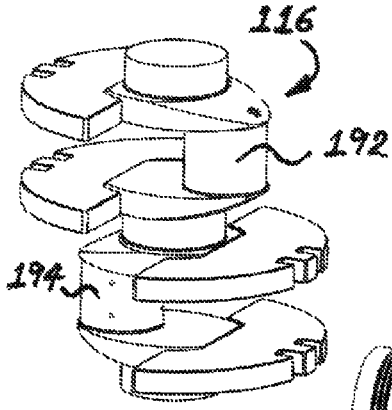
FIG. 9(*a*) is an isometric view of the DASY X-8 engine crankshaft showing the two crankpins.
Figure 9B:
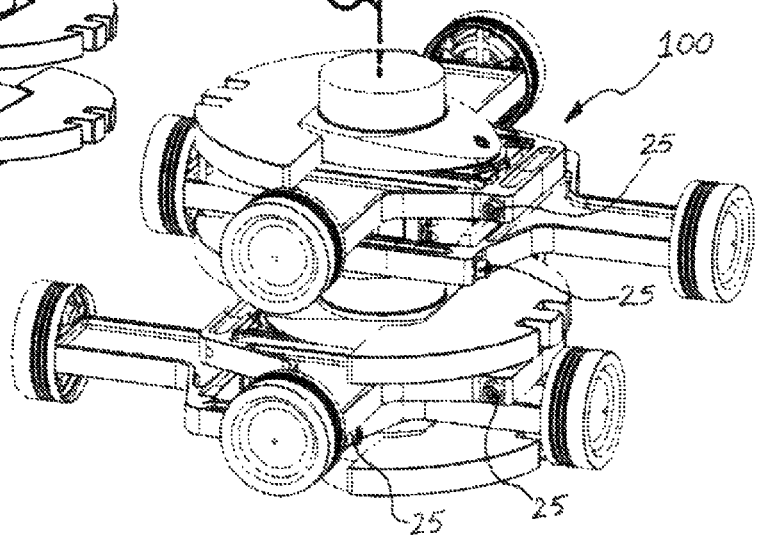
Figure 9C:
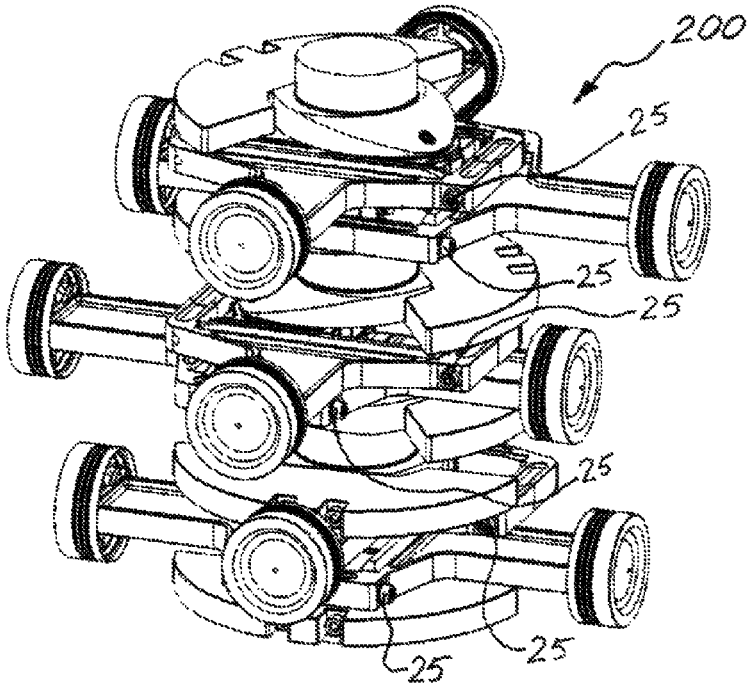

In FIGS. 9(*b, c*) are shown the DASY X-8 engine crank train assembly 100 and the DASY X-12 engine crank train assembly 200, with both assemblies showing that all of the yoke bolts 25 are aligned in one of the two visible corners, to show that the whole family of DASY X-engines from four cylinders on up in increments of four cylinders—X-4, X-8, X-12, X-16—can be assembled as described here for the DASY X-8 engine.

FIG. 10 is a flow chart that describes a method of the invention for assembling the DASY X-engine bottom end assembly with a detailed list of instructions using the various components described above.

In Step 1), the block halves 302, 304 are placed separated from each other with the crank bore vertically oriented with access to the crankcase and the tops of the cylinder bores. In Step 2), a piston assembly, including rings, is installed through the top of each cylinder bore. In Step 3), a yoke is attached onto each piston assembly using bolts. The end of the yoke that the bolt head is set onto is oriented towards the valley opening 361, 362, of a respective block half 302, 304. In Step 4), the piston and yoke sub-assemblies are moved to the tops of the bores. The yokes are oriented so that they are perpendicular to the crank bore.

In Step 5), the bearing shells and the bearing block assemblies are installed onto the crankshaft crankpin journals. There are two bearing block assemblies attached to each crankpin In Step 6), the bearing shells and the thrust bearings are installed into the block halves 302, 304. In Step 7), the crankshaft and the camshafts are set into a respective block half 302 and secured using a temporary fixture. In Step 8), the two block halves 302, 304 are moved together by keeping the dowels aligned with their receiving holes to insure correct engagement. After the block halves 302, 304 are moved together, the block halves 302, 304 are temporarily held using two perimeter bolts attached at low torque. This leaves access through the valley openings 361, 362 for final assembly of the DASY reciprocating assemblies 12.

In Step 9), the bearing block assemblies are rotated on the crankpins into position to receive the yokes. In Step 10), the pistons are pushed down the bores to move each piston and yoke subassembly into proper engagement with a bearing block. It may be necessary to guide the yokes and bearing blocks together by contacting them through the valley openings 361, 362. In Step 11), a yoke bolt 25 is installed through a respective valley opening 361, 362 into each yoke 22, 24 to complete assembly of the DASY reciprocating assemblies 12 after opposing yokes 22, 24 are fully engaged to each other and to a bearing block 14. In Step 12), the temporary fixtures that were used on the crankshaft and the camshafts are removed, and a valley cover 310, 312 is placed over the valley opening 361, 362 of each block half 302, 304. In Step 13), the cylinder block main bolts are installed using the proper torque sequence and torque specification to secure the two block halves 302, 304 and two valley covers 310, 312. All block perimeter bolts are installed to complete the DASY X-engine bottom end assembly.

In conclusion, the invention is directed to a simple cylinder block assembly 300 for X-engine crank trains that has valley openings 361, 362 in two opposite valleys of the "four-valley" X-engine, working in conjunction with a unique double-acting scotch yoke X-4 crank train that places all of the yoke bolts 25 in two opposite corners of a four-corner array, and defining the process to assemble this DASY X-engine utilizing the component designs that are detail described. A key step relating to this invention is step #11 of the block diagram in FIG. 10, which is when the piston and yoke sub-assemblies have been joined together on a bearing block, and the yoke bolts are installed through the valley openings. As can be envisioned by looking at FIG. 1, there is no practical way to connect the block assembly's two block halves (each of which contains two adjacent banks of cylinders) around the completed DASY X-engine crank train assembly, and an X-engine with four banks of cylinders arranged around a central crankshaft insists upon a much different engine bottom end assembly process than can be used for a conventional con rod "V"-configuration engine. Other prior art in this field involves much more complex structures with higher numbers of parts. Thus, these component and assembly designs described herein provide a simple, functional, feasible, low cost solution for the scotch yoke X-engine which is an engine configuration that has potential to be superior to currently manufactured types, and at the same time provides a cylinder block assembly with outstanding strength and stiffness compared to the most commonly produced engine configurations—the "V"-engine, in-line engine, and flat engine.

Having described presently preferred embodiments the invention may be otherwise embodied within the scope of the appended claims.

What is claimed is:

1. A cylinder block assembly for an X-engine, comprising:
a first block half having two cylinder banks;
a second block half fastened to the first block half, the second block half having two cylinder banks, the two cylinder banks of each of the first and second block halves defining an angle greater than 0 degrees and less than 180 degrees;
a first valley opening between the two cylinder banks in the first block half;
a second valley opening between the two cylinder banks in the second block half;
a first valley cover for covering the first valley opening; and
a second valley cover for covering the second valley opening,
wherein the first and second block halves are fastened together using a plurality of threaded fasteners to form four distinct banks of cylinders.

2. The assembly according to claim 1, further comprising a plurality of perimeter bolts for providing additional clamping force to fasten the two block halves together.

3. The assembly of claim 1, wherein the first and second block halves and the first and second valley covers are fastened together using the plurality of threaded fasteners.

4. The assembly according to claim 1, wherein the first block half further includes a plurality of recesses such that a plurality of orifices are formed between the first valley cover and the first block half for allowing a flow of oil therethrough.

5. The assembly according to claim 1, wherein the first and second block halves further comprise a plurality of main bearing mount surfaces for cooperating with a plurality of crankshaft main bearings.

6. The assembly according to claim 5, wherein a bolt hole is located adjacent each main bearing mount surface for cooperating with the plurality of threaded fasteners.

7. The assembly according to claim 1, wherein each of the first and second block halves further comprises a plurality of bearing mount surfaces for cooperating with a plurality of bearings.

8. The assembly according to claim 1, wherein each valley opening enables a yoke bolt to pass therethrough, thereby allowing an X-engine crank train assembly to be assembled within the cylinder block assembly.

9. The assembly according to claim 1, wherein each valley opening is located between adjacent bulkheads of each block half.

10. An X-engine bottom-end assembly comprising:
an X-engine cylinder block assembly including four cylinder banks; a first valley opening located between a first pair of adjacent cylinder banks; and a second valley opening located between a second pair of adjacent cylinder banks; and an X-engine crank train disposed within the X-engine cylinder block assembly comprising a pair of Double-Acting Scotch Yoke (DASY) assemblies having first and second yokes attached to each other, wherein the first and second valley openings allow a yoke bolt to pass therethrough to fasten the first and second yokes of each DASY assembly, and wherein the yoke bolts for each DASY assembly are inserted from opposite directions.

11. The X-engine bottom-end assembly according to claim 10, wherein a plurality of X-engine crank trains are disposed within the X-engine cylinder block assembly.

12. The X-engine bottom-end assembly according to claim 10, further comprising a first valley cover for covering the first valley opening.

13. The X-engine bottom-end assembly according to claim 10, further comprising a second valley cover for covering the second valley opening.

14. A method for assembling the X-engine bottom-end assembly as recited in claim 10, comprising aligning each yoke such that a valley opening allows a yoke bolt to be installed into the first and second yokes of each Double-Acting Scotch Yoke assembly.

15. The method according to claim 14, wherein the X-engine cylinder block assembly further comprises two block halves for allowing components installed therein prior to being joined together, each block half having at least one valley opening, and wherein the method further comprises;

first, installing a piston into each cylinder bore of both block halves;

second, attaching a yoke onto a bottom surface of each piston;

third, installing a crankshaft into the first block half;

fourth, bringing the first and second block halves together such that each block half contacts each other;

fifth, pushing each piston into a cylinder bore to bring opposing yokes into contact with each other around a crankpin on the crankshaft; and sixth, installing the yoke bolts.

16. The method according to claim 15, further comprising:

attaching a valley cover onto each block half to cover the valley openings.

* * * * *